US007226049B2

(12) United States Patent
Lofthus et al.

(10) Patent No.: US 7,226,049 B2
(45) Date of Patent: Jun. 5, 2007

(54) UNIVERSAL FLEXIBLE PLURAL PRINTER TO PLURAL FINISHER SHEET INTEGRATION SYSTEM

(75) Inventors: Robert M. Lofthus, Webster, NY (US); Kristine A. German, Webster, NY (US); David K. Biegelsen, Portola Valley, CA (US); Joannes N. M. deJong, Hopewell Junction, NY (US); Lloyd A. Williams, Mahopac, NY (US); Warren B. Jackson, San Francisco, CA (US)

(73) Assignee: Xerox Corporation, Stamford, CT (US)

( * ) Notice: Subject to any disclaimer, the term of this patent is extended or adjusted under 35 U.S.C. 154(b) by 3 days.

(21) Appl. No.: 10/785,211

(22) Filed: Feb. 24, 2004

(65) Prior Publication Data

US 2004/0253033 A1 Dec. 16, 2004

Related U.S. Application Data

(60) Provisional application No. 60/478,749, filed on Jun. 16, 2003, provisional application No. 60/476,374, filed on Jun. 6, 2003.

(51) Int. Cl.
*B65H 29/00* (2006.01)

(52) U.S. Cl. ..... 271/185; 271/9.01; 271/9.12; 271/9.13; 271/184; 271/279

(58) Field of Classification Search ..... 271/9.01, 271/9.12, 9.13, 184, 185, 279
See application file for complete search history.

(56) References Cited

U.S. PATENT DOCUMENTS 3,861,673 A 1/1975 Ticknor
4,123,113 A * 10/1978 Koss ..... 406/88
4,411,418 A 10/1983 Poehlein
4,438,917 A 3/1984 Janssen et al.
4,511,242 A 4/1985 Ashbee et al.
4,519,700 A 5/1985 Barker et al.
4,579,446 A 4/1986 Fujino et al.
4,587,532 A 5/1986 Asano
4,618,292 A * 10/1986 Judge et al. ..... 406/19

(Continued)

OTHER PUBLICATIONS

*Xerox Disclosure Journal*, Nov.-Dec. 1991, vol. 16, No. 6, pp. 381-383, by Paul F. Morgan.

(Continued)

*Primary Examiner*—Gene O. Crawford
*Assistant Examiner*—Leslie A. Nicholson, III
(74) *Attorney, Agent, or Firm*—Eugene O. Palazzo; Fay Sharpe LLP

(57) ABSTRACT

A multifunction printed sheets interface system with plural sheet input areas for receiving printed sheets from plural printers, plural sheet outputs areas for plural outputs to different sheet processing systems, a sheet position sensing system, and a sheet transporting system providing selectable sheet translation from selected plural sheet input areas to selected plural sheet outputs areas so as to provide selectable sheet feeding from selected printers to selected sheet processing systems, and selectable sheet rotation of selected sheets and selectable sheet merging in a selected sheet sequence of sheets from plural printers. The sheet transporting system has a large planar area with a multiplicity of spaced apart independently operable variable sheet feeding direction and sheet velocity sheet transports, larger than the dimensions of any sheet to be fed thereon to allow simultaneous plural sheet variable transport thereon.

11 Claims, 1 Drawing Sheet

U.S. PATENT DOCUMENTS 4,733,856 A * 3/1988 Gunther, Jr. ..... 270/1.02
4,836,119 A 6/1989 Siraco et al.
4,971,304 A 11/1990 Lofthus
5,004,222 A 4/1991 Dobashi
5,078,384 A 1/1992 Moore
5,080,340 A 1/1992 Hacknauer et al.
5,094,442 A 3/1992 Kamprath et al.
5,095,342 A 3/1992 Farrell et al.
5,100,116 A * 3/1992 Graushar ..... 270/1.02
5,156,391 A 10/1992 Roller
5,159,395 A 10/1992 Farrell et al.
5,169,140 A 12/1992 Wenthe, Jr.
5,208,640 A 5/1993 Horie et al.
5,272,511 A 12/1993 Conrad et al.
5,273,274 A 12/1993 Thomson et al.
5,278,624 A 1/1994 Kamprath et al.
5,326,093 A 7/1994 Sollitt
5,435,544 A 7/1995 Mandel
5,462,399 A * 10/1995 Clupper et al. ..... 414/790.3
5,473,419 A 12/1995 Russel et al.
5,489,969 A 2/1996 Soler et al.
5,504,568 A 4/1996 Saraswat et al.
5,525,031 A 6/1996 Fox
5,547,225 A 8/1996 DeAngelis
5,557,367 A 9/1996 Yang et al.
5,568,246 A 10/1996 Keller et al.
5,570,172 A 10/1996 Acquaviva
5,592,881 A * 1/1997 Rabjohns ..... 101/483
5,596,416 A 1/1997 Barry et al.
5,629,762 A 5/1997 Mahoney et al.
5,634,636 A * 6/1997 Jackson et al. ..... 271/225
5,687,964 A * 11/1997 Stephan et al. ..... 271/195
5,710,968 A 1/1998 Clark et al.
5,778,377 A 7/1998 Marlin et al.
5,810,346 A * 9/1998 Jorg ..... 270/59
5,884,910 A 3/1999 Mandel
5,995,721 A 11/1999 Rourke et al.
6,059,284 A 5/2000 Wolf et al.
6,075,924 A * 6/2000 Will ..... 700/260
6,125,248 A 9/2000 Moser
6,125,760 A * 10/2000 Graushar et al. ..... 101/490
6,241,242 B1 6/2001 Munro
6,297,886 B1 10/2001 Cornell
6,341,773 B1 1/2002 Aprato et al.
6,384,918 B1 5/2002 Hubble, III et al.
6,450,711 B1 9/2002 Conrow
6,476,376 B1 11/2002 Biegelsen et al.
6,476,923 B1 11/2002 Cornell
6,493,098 B1 12/2002 Cornell
6,537,910 B1 3/2003 Burke et al.
6,550,762 B2 4/2003 Stoll
6,554,276 B2 4/2003 Jackson et al.
6,577,925 B1 6/2003 Fromherz
6,607,320 B2 8/2003 Bobrow et al.
6,608,988 B2 8/2003 Conrow
6,612,566 B2 9/2003 Stoll
6,612,571 B2 9/2003 Rider
6,621,576 B2 9/2003 Tandon et al.
6,633,382 B2 10/2003 Hubble, III et al.
6,639,669 B2 10/2003 Hubble, III et al.
6,735,332 B1 * 5/2004 Goldberg et al. ..... 382/141
6,819,906 B1 11/2004 Herrmann et al.
7,043,309 B2 * 5/2006 Jackson et al. ..... 700/19
2002/0078012 A1 6/2002 Ryan et al.
2002/0103559 A1 8/2002 Gartstein
2003/0002447 A1 * 1/2003 Jackson et al. ..... 370/254
2003/0077095 A1 4/2003 Conrow
2003/0080486 A1 * 5/2003 Ifkovits et al. ..... 270/52.14
2004/0085561 A1 5/2004 Fromherz
2004/0085562 A1 5/2004 Fromherz
2004/0088207 A1 5/2004 Fromherz
2004/0150156 A1 8/2004 Fromherz et al.
2004/0150158 A1 8/2004 Biegelsen et al.
2004/0153983 A1 8/2004 McMillan
2004/0216002 A1 10/2004 Fromherz et al.
2004/0225391 A1 11/2004 Fromherz et al.
2004/0225394 A1 11/2004 Fromherz et al.
2004/0247365 A1 12/2004 Lofthus et al.

OTHER PUBLICATIONS

Xerox Aug. 3, 2001, "TAX 1129" publication product announcement entitled "Cluster Printing Solution Announced".
U.S. Appl. No. 10/761,522, filed Jan. 21, 2004, Mandel, et al.
U.S. Appl. No. 10/785,211, filed Feb. 24, 2004, Lofthus, et al.
U.S. Appl. No. 10/881,619, filed Jun. 6, 2004, Bobrow.
U.S. Appl. No. 10/917,676, filed Aug. 13, 2004, Lofthus, et al.
U.S. Appl. No. 10/917,768, filed Aug. 13, 2004, Lofthus, et al.
U.S. Appl. No. 10/924,106, filed Aug. 13, 2004, Lofthus, et al.
U.S. Appl. No. 10/924,113, filed Aug. 23, 2004, deJong, et al.
U.S. Appl. No. 10/924,458, filed Aug. 23, 2004, Lofthus, et al.
U.S. Appl. No. 10/924,459, filed Aug. 12, 2004, Mandel, et al.
U.S. Appl. No. 10/933,556, filed Sep. 3, 2004, Spencer, et al.
U.S. Appl. No. 10/953,953, filed Sep. 29, 2004, Radulski, et al.
U.S. Appl. No. 10/999,326, filed Nov. 30, 2004, Grace, et al.
U.S. Appl. No. 10/999,450, filed Nov. 30, 2004, Lofthus, et al.
U.S. Appl. No. 11/000,158, filed Nov. 30, 2004, Roof.
U.S. Appl. No. 11/000,168, filed Nov. 30, 2004, Biegelsen, et al.
U.S. Appl. No. 11/000,258, filed Nov. 30, 2004, Roof.
U.S. Appl. No. 11/001,890, filed Dec. 2, 2004, Lofthus, et al.
U.S. Appl. No. 11/002,528, filed Dec. 2, 2004, Lofthus, et al.
U.S. Appl. No. 11/051,817, filed Feb. 4, 2005, Moore, et al.
U.S. Appl. No. 11/070,681, filed Mar. 2, 2005, Viturro, et al.
U.S. Appl. No. 11/081,473, filed Mar. 16, 2005, Moore.
U.S. Appl. No. 11/069,020, filed Feb. 28, 2005, Lofthus, et al.
U.S. Appl. No. 11/089,854, filed Mar. 25, 2005, Clark, et al.
U.S. Appl. No. 11/090,498, filed Mar. 25, 2005, Clark.
U.S. Appl. No. 11/090,502, filed Mar. 25, 2005, Mongeon.
U.S. Appl. No. 11/095,378, filed Mar. 31, 2005, Moore, et al.
U.S. Appl. No. 11/094,998, filed Mar. 31, 2005, Moore, et al.
U.S. Appl. No. 11/094,864, filed Mar. 31, 2005, de Jong, et al.
U.S. Appl. No. 11/095,872, filed Mar. 31, 2005, Julien, et al.
U.S. Appl. No. 11/102,355, filed Apr. 8, 2005, Fromherz, et al.
U.S. Appl. No. 11/084,280, filed Mar. 18, 2005, Mizes.
U.S. Appl. No. 11/109,566, filed Apr. 19, 2005, Mandel, et al.
U.S. Appl. No. 11/109,558, filed Apr. 19, 2005, Furst, et al.
U.S. Appl. No. 11/109,996, filed Apr. 20, 2005, Mongeon, et al.
U.S. Appl. No. 11/093,229, filed Mar. 29, 2005, Julien.
U.S. Appl. No. 11/102,899, filed Apr. 8, 2005, Crawford, et al.
U.S. Appl. No. 11/102,910, filed Apr. 8, 2005, Crawford, et al.
U.S. Appl. No. 11/115,766, filed Apr. 27, 2005, Grace.
U.S. Appl. No. 11/102,332, filed Apr. 8, 2005, Hindi, et al.
U.S. Appl. No. 11/136,959, filed Apr. 25, 2005, German, et al.
U.S. Appl. No. 11/136,821, filed May 25, 2005, Robinson.
U.S. Appl. No. 11/122,420, filed May 5, 2005, Richards.
U.S. Appl. No. 11/137,634, filed May 25, 2005, Lofthus, et al.
U.S. Appl. No. 11/137,251, filed May 25, 2005, Lofthus, et al.
U.S. Appl. No. 11/137,273, filed May 25, 2005, Anderson, et al.

* cited by examiner

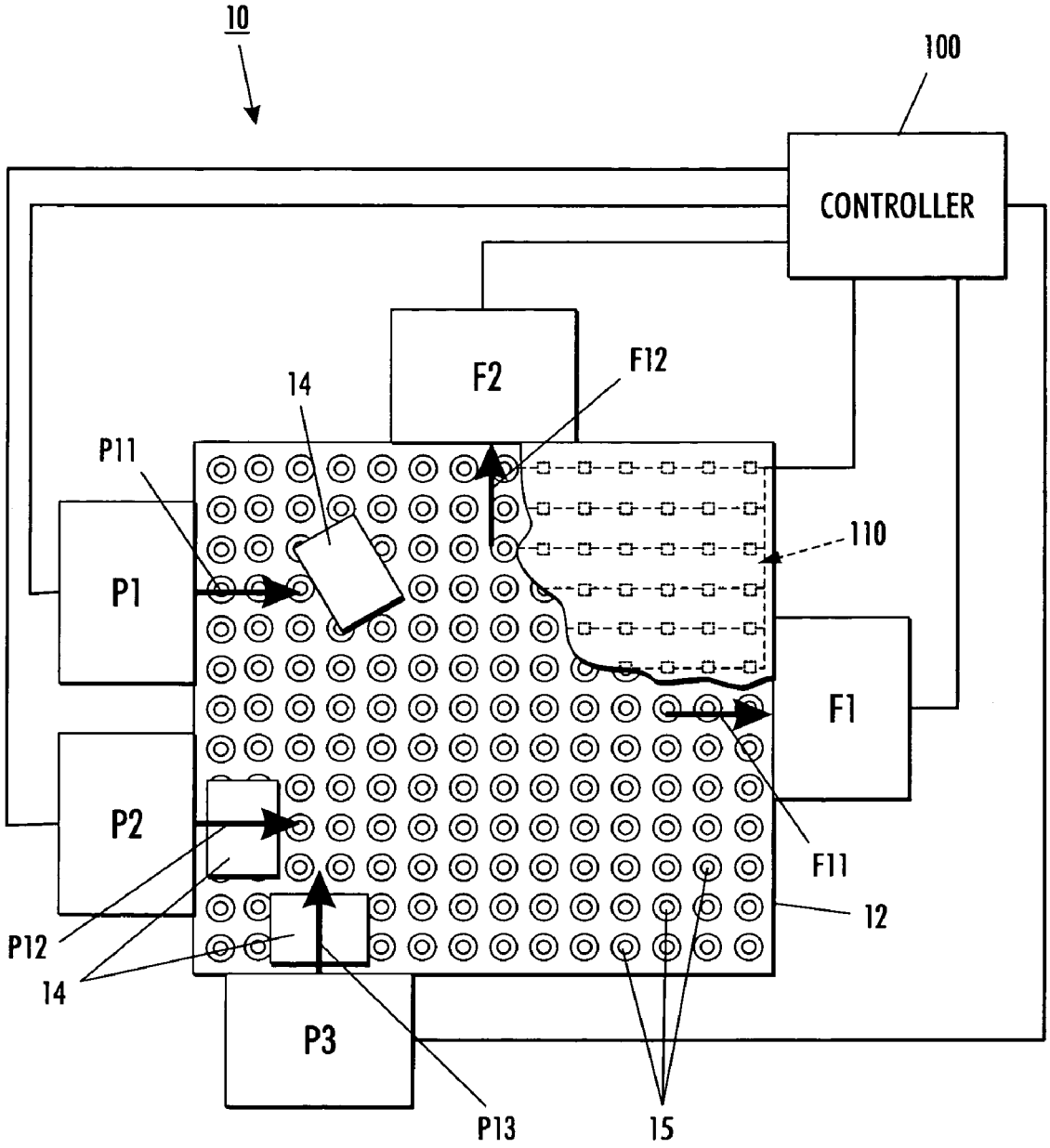
10
100
CONTROLLER
F2
F12
14
P11
110
P1
F1
P2
F11
12
P12
14
P3
P13
15

UNIVERSAL FLEXIBLE PLURAL PRINTER TO PLURAL FINISHER SHEET INTEGRATION SYSTEM

This application claims the benefit of Provisional Patent Application No. 60/476,374, filed Jun. 6, 2003. The application also claims the benefit of Provisional Patent Application No. 60/478,749, filed Jun. 16, 2003, the disclosure of which is incorporated herein in its entirety, by reference.

BACKGROUND

Disclosed in the embodiment herein is a flexible integration system for receiving printed sheets from plural printers and selectably directing those printed sheets to plural sheet outputs areas for plural outputs to selectably different sheet processing systems, such as different finishers, with a sheet position sensing system and a dual-axis flexible sheet transporting system (which may be integrated in a planer table device). The disclosed sheet transporting system of the embodiment provides selectable sheet translation movement and/or rotation from selected ones of said plural sheet input areas to selected ones of said plural sheet outputs areas so as to provide selectable sheet feeding from selected printers to selected sheet processing systems.

A large area of multiple spaced sheet driving elements (providing variable angle sheet driving directions) and sensors may be provided in an intelligent, adaptive, scaleable, closed-loop paper path plane, which can simultaneously enter, exit, move and re-position multiple sheets thereon. Any sheet entering at any position can be moved to any other location in the paper path plane. With a variable velocity as well as variable angle sheet movement system in the disclosed embodiment, the outputs of slower PPM printers with slower sheet velocities can be combined into a single or plural sheet output streams of higher velocities and PPM rates. Continuous feedback sensing of sheet positions can be provided.

BRIEF SUMMARY

In accordance with aspects of the exemplary embodiment a multifunction printed sheets interface system and method of directing printed sheets are provided. In one aspect, the multifunction printed sheets interface system includes plural sheet input areas, plural sheet outputs areas, a sheet position sensing system, and a sheet transporting system. The sheet transporting system includes independently operable sheet transports and provides selectable sheet translation to selectably transport sheets from selected ones of the plural sheet input areas to selected ones of the plural sheet outputs areas. The sheet transports provide variable angle driving for selectable sheet rotation and translation of selected sheets.

In another aspect, a system includes a plurality of printers, a plurality of sheet processing systems, and a multifunction printed sheets interface system. The interface system includes a plurality of sheet input areas which receive printed sheets from the plurality of printers, a plurality of sheet outputs areas which provide plural outputs to different ones of the sheet processing systems, a sheet position sensing system, and a sheet transporting system. The sheet transporting system provides selectable sheet translation to selectably transport sheets from selected ones of the plural sheet input areas to selected ones of the plural sheet outputs areas so as to provide selectable sheet feeding from selected printers to selected sheet processing systems.

In another aspect, the method includes printing sheets on a plurality of printers and feeding the printed sheets from the plurality of printers to a plurality of respective input areas of a printed sheets interface system. The printed sheets are transported from the input areas to selected ones of a plurality of output areas of the printed sheets interface system with a plurality of sheet transports. A position of the printed sheets is sensed during transporting.

BRIEF DESCRIPTION OF THE DRAWING

FIG. 1 is a schematic top view of one example of the subject multifunction printed sheets interface system.

DETAILED DESCRIPTION

With the disclosed embodiment, the inputs and outputs of plural lower speed printers, different paper feeders and different output devices can be more readily and flexibly combined into collated print jobs with the printing speed of a much higher speed printer.

Although not limited thereto, incorporated by reference, where appropriate, by way of background, are the following references variously relating to what have been variously called "tandem engine" printers, "parallel" printers, or "cluster printing" (in which an electronic print job may be split up for distributed higher productivity printing by different printers, such as separate printing of the color and monochrome pages), "output merger" or "interposer" systems, etc. For example, Xerox Corp. U.S. Pat. No. 5,568,246 issued Oct. 22, 1996; Canon Corp. U.S. Pat. No. 4,587,532; Xerox Corp. U.S. Pat. No. 5,570,172 to Acquaviva; T/R Systems Barry et al U.S. Pat. No. 5,596,416; Xerox Corp. U.S. Pat. No. 5,995,721 to Rourke et al; Canon Corp. Fujino U.S. Pat. No. 4,579,446; a 1991 "Xerox Disclosure Journal" publication of November-December 1991, Vol. 16, No. 6, pp. 381-383 by Paul F. Morgan; and a Xerox Aug. 3, 2001 "TAX" publication product announcement entitled "Cluster Printing Solution Announced." One example of a Xerox Corp. sheet "interposer" patent is U.S. Pat. No. 5,389,969.

Also noted are commonly assigned Xerox Corp. U.S. Pat. No. 6,554,276, by Jackson, et al, and U.S. Pat. No. 6,607,320, by Bobrow, et al, with sheet positioners and sheet "reverters," respectively issued on Apr. 29, 2003 and Aug. 19, 2003, both of which were filed on Mar. 30, 2001 and published on Oct. 3, 2002.

By way of an example of a variable vertical level, rather than horizontal, "universal" input and output sheet path interface connection from a single printer to a single finisher, there is Xerox Corp. U.S. Pat. No. 5,326,093. This patent is noted and incorporated as demonstrating that additional possible optional input and/or output feature here, since various different printers and third party finishers may have different sheet output levels and sheet input levels.

The exemplary multiple selectively directional (variable drive angle) sheet transports disclosed in this embodiment for two-axis sheet movement and/or rotation are the "SNIPS" systems already described an shown in Xerox Corp. U.S. Pat. No. 6,059,284 issued May 9, 2000. These SNIPS systems may thus be schematically represented herein, and need not be described in detail herein. Also noted as to somewhat similar transport systems are an MIT Draper Lab U.S. Pat. No. 4,836,119 and a Hewlett-Packard U.S. Pat. No. 6,241,242 issued Jun. 5, 2001. As disclosed in said U.S. Pat. No. 6,059,284, each SNIPS sheet drive has a spherical frictional drive ball engaging any overlying sheet, which drive ball is rotated in any desired direction and speed by two orthogonal servo-driven rollers drivingly engaging the opposite side of the ball. Overlying idler balls, pneumatic pressure or suction, or other known paper feeding normal force systems may be added, if desired, to hold the sheets down against the drive balls in addition to sheet gravity.

Various large area multiple optical sensor arrays, such as with LED's and multiple pixel photocells, with SELFOC or other collimating lenses, may be used, and are also known in the art, and in the imaging bar art, and need not be described in detail herein. Particularly noted and incorporated by reference herein is U.S. Pat. No. 6,476,376 B1 filed Jan. 16, 2002 and issued Nov. 5, 2002 by David K. Biegelsen, Bryan Preas, Lars Erik Swartz and Warren B. Jackson. FIGS. 9 and 11 thereof are noted in particular. Various large area two-dimensional optical object orientation and/or recognition sensors, such as overhead video cameras and associated software, are also known.

A specific feature of the specific embodiments disclosed herein is to provide a multifunction printed sheets interface system, comprising plural sheet input areas for receiving printed sheets from plural printers, plural sheet outputs areas for plural outputs to different sheet processing systems, a sheet position sensing system, and a sheet transporting system, said sheet transporting system providing selectable sheet translation to selectably transport sheets from selected ones of said plural sheet input areas to selected ones of said plural sheet outputs areas so as to provide selectable sheet feeding from selected printers to selected sheet processing systems.

Further specific features disclosed in the embodiment herein, individually or in combination, include those wherein said sheet transporting system additionally provides selectable sheet rotation of selected sheets; and/or wherein said sheet transporting system additionally provides selectable sheet merging in a selected sheet sequence of sheets from said plural printers to a selected said sheet processing system; and/or wherein said sheet transporting system comprises a multiplicity of spaced and independently operable variable-sheet-feeding-direction sheet transports; and/or wherein said sheet transporting system is a generally planar sheet feeding table larger than the dimensions of any sheet to be fed thereon for simultaneous plural sheet variable transport thereon; and/or wherein said sheet transporting system has a large planar area with a multiplicity: of spaced apart independently operable variable sheet feeding direction and sheet velocity sheet transports, said large planar area being substantially larger than the dimensions of any sheet to be fed thereon to allow simultaneous plural sheet variable transport thereon by said multiplicity of spaced apart independently operable variable sheet feeding direction and sheet velocity sheet transports, said sheets being sensed thereon by said sheet position sensing system, and said sheet position sensing system controlling said multiplicity of spaced apart independently operable variable sheet feeding direction and sheet velocity sheet transports.

The disclosed system may be operated and controlled by appropriate operation of conventional control systems. It is well known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as those provided herein, and/or prior knowledge of functions which are conventional, together with general knowledge in the software or computer arts. Alternatively, the disclosed control system or method may be implemented partially or fully in hardware, using standard logic circuits or single chip VLSI designs.

The term "reproduction apparatus" or "printer" as used herein broadly encompasses various printers, copiers or multifunction machines or systems, xerographic or otherwise, unless otherwise defined in a claim. The term "sheet" herein refers to a usually flimsy physical sheet of paper, plastic, or other suitable physical print media substrate for images, whether precut or web fed. A "copy sheet" may be abbreviated as a "copy" or called a "hardcopy." A "print job" is normally a set of related sheets, usually one or more collated copy sets copied from a set of original document sheets or electronic document page images, from a particular user, or otherwise related.

A "finisher," as broadly used herein, is any post-printing accessory device such as an inverter, sorter, mailbox, inserter, interposer, folder, stapler, binder, over-printer, envelope stuffer, postage machine, etc.

As to specific components of the subject apparatus or methods, or alternatives therefor, it will be appreciated that, as is normally the case, some such components are known per se in other apparatus or applications, which may be additionally or alternatively used herein, including those from art cited herein. For example, it will be appreciated by respective engineers and others that many of the particular component mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

Various of the above-mentioned and further features and advantages will be apparent to those skilled in the art from the specific apparatus and its operation or methods described in the example(s) below, and the claims. Thus, the present invention will be better understood from this description of these specific embodiment(s), including the drawing FIGURES (which are approximately to scale) wherein:

Describing now in further detail this exemplary embodiment, there is shown in FIG. 1 a large area planar multifunction printed sheets interface system 10, adapted to receive an input of printed sheets 14 from schematically illustrated, otherwise conventional, printers P1, P2, P3, all feeding their printed sheets outputs to selectable different input positions on this exemplary printed sheets interface system 10. The system 10 includes a variably selectable sheet transporting system, here comprising generally planar sheet feeding table 12 larger than the dimensions of any sheet 14 to be fed thereon, with variably selectable inputs P11, P12, and/or P13 from the printers P1, P2, and/or P3, and outputs F11, F12, in this example, to conventional selectable and repositionable finisher units F1 and/or F2. The unit 10 has, over the table 12 here, a multiplicity of spaced apart and independently operable variable sheet feeding direction and sheet feeding velocity sheet transports. Those transports are provided in this example by the above-described SNIPS patent U.S. Pat. No. 6,059,284 system 15 (incorporated by reference), independently controlled by a controller 100 to drive the sheets from any input to any output, with or without sheet rotation, by their variable angle driving. The SNIPS spacings are closer than the smallest sheet to be fed. The controller 100 is also operatively connected to a large area sheet position sensing system 110 distributed over the table 12 area. The controller 100 may also be operatively connected to the clustered printers P1, P2, and P3, and/or the optional finisher units F1 and F2. The number of sheet inputs and outputs, and their locations, which can be provided by the unit 10 is completely flexible. Only the software, not the hardware, need be changed for such different applications and functions.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims.

What is claimed is:

1. A multifunction printed sheets interface system comprising:

plural sheet input areas, plural sheet outputs areas, a sheet position sensing system, and a sheet transporting system comprising a plane having first and second angularly spaced sides, said sheet transporting system comprising independently operable sheet transports and providing selectable sheet translation in the plane to selectably transport sheets from selected ones of said plural sheet input areas to selected ones of said plural sheet outputs areas so as to provide selectable sheet feeding from selected sheet input areas to selected sheet outputs areas, said sheet transports providing variable angle driving for selectable sheet rotation and translation of selected sheets in the plane whereby said sheets are selectably contemporaneously transportable in different directions towards said plural sheet outputs areas, a first of the sheet outputs areas being adjacent the first angularly spaced side of the plane and a second of said sheet outputs areas being adjacent the second angularly spaced side of the plane, wherein said sheet transporting system has a large planar area with a multiplicity of spaced apart independently operable variable sheet feeding direction and sheet velocity sheet transports, said large planar area being substantially larger than the dimensions of any sheet to be fed thereon to allow simultaneous plural sheet variable transport thereon by said multiplicity of spaced apart independently operable variable sheet feeding direction and sheet velocity sheet transports, said sheets being sensed thereon by said sheet position sensing system, and said sheet position sensing system controlling said multiplicity of spaced apart independently operable variable sheet feeding direction and sheet velocity sheet transports.

2. The multifunction printed sheets interface system of claim 1, wherein said sheet transporting system additionally provides selectable sheet merging in a selected sheet sequence of sheets from said plural sheet input areas to a selected one of said sheet outputs areas.

3. The multifunction printed sheets interface system of either one of claims 1 and 2, wherein said sheet transporting system is a generally planar sheet feeding table larger than the dimensions of any sheet to be fed thereon for simultaneous plural sheet variable transport thereon.

4. The multifunction printed sheets interface system of claim 1, wherein a plurality of said sheet transports are each closer to four other sheet transports than the smallest sheet to be fed.

5. The multifunction printed sheets interface system of claim 1, the sheet transporting system further comprising:

a controller which independently controls the sheet transports to provide selectable sheet feeding from any one of the sheet input areas to any one of the sheet outputs areas.

6. A system comprising:

a plurality of printers;

a plurality of sheet processing systems; and a multifunction printed sheets interface system which comprises a generally planar sheet feeding table larger than the dimensions of any sheet to be fed thereon for simultaneous variable transport of a plurality of sheets thereon and comprising:

a plurality of sheet input areas which receive printed sheets from the plurality of printers, each of the printers feeding printed sheets to a respective one of the sheet input areas, a plurality of sheet outputs areas which provide plural outputs to different ones of the sheet processing systems, first and second of the sheet input areas being positioned relative to first and second of the sheet outputs areas such that a oath of a sheet transported between the first input area and the first outputs area crosses a path of a sheet being transported between the second input area and the second outputs area, a sheet position sensing system, and a sheet transporting system, said sheet transporting system providing selectable sheet translation to selectably transport sheets contemporaneously from selected ones of said plural sheet input areas to selected ones of said plural sheet outputs areas so as to provide simultaneous selectable sheet feeding from selected printers to selected sheet processing systems, including contemporaneous feeding in the crossing paths.

7. The system of claim 6, wherein said sheet transporting system additionally provides selectable sheet rotation of selected sheets.

8. The multifunction printed sheets interface system of claim 6, wherein said sheet transporting system comprises a multiplicity of spaced and independently operable variable-sheet-feeding-direction sheet transports.

9. The multifunction printed sheets interface system of claim 6, wherein said sheet transporting system has a large planar area with a multiplicity of spaced apart independently operable variable sheet feeding direction and sheet velocity sheet transports, said large planar area being substantially larger than the dimensions of any sheet to be fed thereon to allow simultaneous plural sheet variable transport thereon by said multiplicity of spaced apart independently operable variable sheet feeding direction and sheet velocity sheet transports, said sheets being sensed thereon by said sheet position sensing system, and said sheet position sensing system controlling said multiplicity of spaced apart independently operable variable sheet feeding direction and sheet velocity sheet transports.

10. A method comprising:

printing sheets on a plurality of printers;

feeding the printed sheets from the plurality of printers to a plurality of spaced respective input areas, each of the plurality of input areas being adjacent a side of a planar printed sheets interface system;

transporting the printed sheets in the planar printed sheets interface system with a plurality of sheet transports from the input areas to selected ones of a plurality of spaced output areas, each of the plurality of output areas being adjacent a side of the planar printed sheets interface system, whereby a sheet transported in the planar printed sheets interface system between a first of the input areas and a first of the outputs areas crosses a path of a sheet being contemporaneously transported in the planar printed sheets interface system between a second of the input areas and a second of the outputs areas; and sensing a position of the printed sheets during transporting.

11. The method of claim 10, wherein said transporting includes selectively transporting sheets in a first direction, a second direction perpendicular to the first direction, and a third direction angularly spaced between the first and second directions.

* * * * *